US011380349B2

(12) United States Patent
Mitchell et al.

(10) Patent No.: US 11,380,349 B2
(45) Date of Patent: Jul. 5, 2022

(54) SECURITY SYSTEM

(71) Applicant: Audio Analytic Ltd, Cambridgeshire (GB)

(72) Inventors: Christopher James Mitchell, Cambridgeshire (GB); Sacha Krstulovic, Cambridgeshire (GB); Cagdas Bilen, Cambridgeshire (GB); Neil Cooper, Cambridgeshire (GB); Julian Harris, Cambridgeshire (GB); Arnoldas Jasonas, Cambridgeshire (GB); Joe Patrick Lynas, Cambridgeshire (GB)

(73) Assignee: AUDIO ANALYTIC LTD, Cambridgeshire (GB)

( * ) Notice: Subject to any disclaimer, the term of this patent is extended or adjusted under 35 U.S.C. 154(b) by 0 days.

(21) Appl. No.: 16/580,892

(22) Filed: Sep. 24, 2019

(65) Prior Publication Data

US 2021/0090591 A1 Mar. 25, 2021

(51) Int. Cl.
*G10L 25/51* (2013.01)

(52) U.S. Cl.
CPC ..... *G10L 25/51* (2013.01)

(58) Field of Classification Search
CPC ..... G10L 25/51; G10L 25/93
USPC ..... 381/56, 122, 91; 704/273, 274
See application file for complete search history.

(56) References Cited

U.S. PATENT DOCUMENTS 5,412,738 A * 5/1995 Brunelli ..... G06K 9/00885 382/115
2015/0379836 A1* 12/2015 Nye ..... G08B 29/188 340/565
2016/0247341 A1* 8/2016 Talwerdi ..... H04N 1/00795

* cited by examiner

*Primary Examiner* — Vivian C Chin
*Assistant Examiner* — Con P Tran
(74) *Attorney, Agent, or Firm* — Tarolli, Sundheim, Covell & Tummino LLP

(57) ABSTRACT

Verification of presence of a detected target is carried out following an initial presence determination on the basis of detected non-verbal sound.

8 Claims, 5 Drawing Sheets

SECURITY SYSTEM

FIELD

The present disclosure generally relates to managing access to a controlled location, and to detection and identification of individuals accessing such a location.

BACKGROUND

Background information on sound recognition systems and methods can be found in the applicant's PCT application WO2010/070314, which is hereby incorporated by reference in its entirety.

The present applicant has recognised the potential for new applications of sound recognition systems.

SUMMARY

This disclosure takes account of earlier attempts to produce security systems which seek to verify presence.

An aspect of embodiments disclosed herein comprises a computer system for detecting a presence at a designated location, the system comprising a sound detector for detecting a non-verbal sound, a sound processor for processing the non-verbal sound to determine if the non-verbal sound is indicative of the presence of an identity verification target, and a verification unit for verification of the identity of the target.

On the basis of verification of identity, an authorisation verification can be carried out, to determine if the identified target is authorised to be in the designated location. For clarity, references herein to authorisation are not limited to security considerations, and implementations can be adapted to other applications, such as accreditation, validation, recognition of identifiable targets, confirmation that such an identifiable targets can or should be in a particular monitored location, or other authentication processes in the broadest sense.

In general terms, therefore, an aspect of the disclosure can provide a system, and associated computer implemented method, for determining identity of a target, following detection of the presence of the target using recognition of non-verbal sounds.

For instance, presence of a human can be recognised from human-generated sounds such as footsteps or speech sounds, and such presence recognition can be coupled with an identity check, where the identity check can be performed by one or several of: voice identification, face recognition, barcode/QR code reading or optical character recognition from an ID document.

Aspects of the disclosure may implement a computer system operable to secure articles of property in a location, or to secure a boundary of a location. For example, an application of aspects of the disclosure may implement a system for managing the opening of a door. Specifically, a garage door may be controlled so that it opens on recognition of particular recognised vehicles with authority or consent to enter a property. In another specific example, a door to a property may be opened on identification of a person permitted to enter that property. In another specific example, a system implementing aspects of the present disclosure may simply record information pertaining to detected behaviour. So, for instance, it may record a time of arrival of identified people. It may be configured to play greeting sounds on recognition of certain people, such as to inform a newly arrived person of relevant messages, or to enable prevention of attacks on a user.

For example, a device may be deployed in a location, for instance a hotel room, the device being operable to detect sounds in that location. On the basis of a recognition process on the device, or performed as a service supplied to the device, intrusion-related sounds (e.g. the sound of a suitcase zipper, wardrobe doors being opened) may be detected though the device user may not be present. Then, on detection of such a sound, the device may seek verification as to the identity of the emitter of these sounds and take action in relation to that.

For example, a device may be deployed in a location with the objective of securing a motor vehicle. On the basis of a recognition process on the device, or performed as a service supplied to the device, sounds associated with car break-in or tampering (glass break, footsteps, car alarm) can be detected and, if so detected, the device can then seek to verify the identity of car owner. Further, for enhancement of owner experience, a car may, on recognition of a particular driver, be configured to play a greeting or to implement certain configuration tasks such as adjustment of mirrors and seats and initiation of preferred audio player settings.

For example, arrival of particular individuals in a location can be monitored. A device can be deployed in a location with the objective of determining if an individual has arrived in that location and, if so, if that individual can be verified. On the basis of a recognition process on the device, or performed as a service supplied to the device, sounds associated with a person entering a home (footsteps, keys unlock, child laugh, silence, speech) can be determined. On determination of a person arriving at the premises in question, an identification process may be implemented to determine if the person is a desired target person. For instance, the device can initiate a voice identification process—it can initiate an audible output to invite the arriving person to utter a phrase, which may be a pass-phrase, and then the speech may be used to in a verification process by voice identification.

For example, a device can be deployed with an aspect of an embodiment disclosed herein to trigger on the basis of a suspicious noise in a monitored location. For instance, on the basis of a recognition process on the device, or performed as a service supplied to the device, the device may be configured to detect and identify sounds which can be associated with the presence of a person outdoors on home premises (footsteps, speech, dog barking, anomalous sound) and this can be used to trigger a verification process to seek to verify identity of home occupiers by voice identification.

For example, a device can be deployed to verify a delivery operative as authorised. The device can be configured, on the basis of a recognition process on the device, or performed as a service supplied to the device, to detect and identify sounds associated with the approach of a delivery to a front door of a premises, for example by the sound of a door knock, doorbell, footsteps, vehicle reversing beeps, van engine, van door slamming. On this basis, it can then and seek to verify the identity of an authorised delivery operative, for example by a token recognition process, such as reading a delivery barcode or a QR code, or performing an optical character recognition process on an identification document carried by the delivery operative.

Identity verification may also span the identity of other moving subjects than humans, for example verifying if the presence of a particular dog with a characteristic bark or breed is authorised into the monitored environment, monitoring if livestock is authorised to approach certain farm facilities by reading their identity from barcodes (or other tags, such as RFID tags) attached to their ears, or checking if a car approaching a driveway has a number plate which indicates that it belongs to one of the regular occupiers of the monitored location.

An aspect of embodiments disclosed herein comprises:

A computer system with a microphone, an analogue-to-digital audio converter, a processor and a memory, thereafter denoted "sound recognition computer", shortened as "sound recogniser"

The same computer or another computer with a processor and memory, thereafter denoted "identity verification computer", shortened as "identity verifier". For some identification methods, it may be desirable for the identity verification computer to provide a microphone, a camera, a barcode reader, a keypad, or other accessories to enable an identity verification process.

If the sound recognition and identity verification computers are different computing units, for example in the case where parts of the process are being executed in the cloud, then they should be linked by a networking protocol of some definition (e.g. IP networking, Wifi, Bluetooth, combination thereof etc.).

In an embodiment, the sound recognition computer may continuously transform the audio captured through the microphone into a stream of digital audio samples.

In an embodiment, the sound recognition computer may continuously perform a process to recognise non-verbal sounds from the incoming stream of digital audio samples. From this, the sound recognition computer may produce a sequence of identifiers for the recognised non-verbal sounds.

In an embodiment, from the sequence of sound identifiers, the sound recognition computer may perform a process to determine whether sequence of identifiers are indicative of presence of a subject of interest, such as a human, an animal, a car etc.

In an embodiment, the identity verification computer may be responsive to an indication that a presence has been recognised, to run a process of identity verification which may span, for example:

Creating a user interface (such as audio or visual) to invite the subject whose presence is recognised to speak into a microphone, so that voice identification can be performed to verify their identity from the sound of their voice;

Creating a user interface (such as audio or visual) to invite the subject to submit to another biometric identification methods such as fingerprint recognition or iris scanning;

Creating a user interface (such as audio or visual) to invite the subject to present an identification token, such as a barcode or a QR code printed on an identification document or on a parcel to be delivered, whereby the barcode is read and verified via laser or camera by the identity verification computer;

Creating a user interface (such as audio or visual) to invite the subject to present an ID document on which the identity verification computer can perform optical character recognition, for example recognising and verifying a passport number automatically via a camera;

Seeking identity information that is non-verbally emitted by the subject, for example facial recognition, recognition of characteristic sounds made by an animal (such as a dog's bark), or detecting the plate number of an approaching vehicle, without requiring the subject to perform any special action.

This process may require access to a database of identifying information (for example fingerprint records, voice prints or identification codes), either stored on the identity verification computer, or queried via networking to another computer.

The identity verification computer may then perform a process to combine recognition of presence and identity information into a decision as to authorisation. This may render a result as to whether the detected presence is authorised, unauthorised or unidentified. On the basis of this result, a decision may then be taken by further computer implemented processes, to initiate further action, for example unlocking a smart door lock in case of authorised presence, or sending an alert to a user's mobile phone in case of unauthorised or unidentified presence.

It should be noted that this authorisation decision may require access to an identity authorisation (a.k.a. access control) database, either stored into the identity verification computer, or queried from a separate computer, possibly via networking.

The identity database and authorisation database may be separate or combined into a single database. For example, in the case of checking authorisation of a delivery clerk, the identity and authorisation data would be held by the delivery business. On the other hand, for authorisation of presence of family members into their own house, the data would be held by the system owner. At the lower extreme, the identity and authorisation databases could contain only one identity which would be that of the single system owner whose presence is authorised or expected within the perimeter monitored by the system.

It will be appreciated that the functionality of the devices described herein may be divided across several modules. Alternatively, the functionality may be provided in a single module or a processor. The or each processor may be implemented in any known suitable hardware such as a microprocessor, a Digital Signal Processing (DSP) chip, an Application Specific Integrated Circuit (ASIC), Field Programmable Gate Arrays (FPGAs), GPU (Graphical Processing Unit), TPU (Tensor Processing Unit) or NPU (Neural Processing Unit) etc. The or each processor may include one or more processing cores with each core configured to perform independently. The or each processor may have connectivity to a bus to execute instructions and process information stored in, for example, a memory.

The invention further provides processor control code to implement the above-described systems and methods, for example on a general purpose computer system or on a digital signal processor (DSP) or on a specially designed math acceleration unit such as a Graphical Processing Unit (GPU) or a Tensor Processing Unit (TPU). The invention also provides a carrier carrying processor control code to, when running, implement any of the above methods, in particular on a non-transitory data carrier—such as a disk, microprocessor, CD- or DVD-ROM, programmed memory such as read-only memory (Firmware), or on a data carrier such as an optical or electrical signal carrier. The code may be provided on a carrier such as a disk, a microprocessor, CD- or DVD-ROM, programmed memory such as non-volatile memory (e.g. Flash) or read-only memory (Firmware). Code (and/or data) to implement embodiments of the invention may comprise source, object or executable code in a conventional programming language (interpreted or compiled) such as C, or assembly code, code for setting up or controlling an ASIC (Application Specific Integrated Circuit) or FPGA (Field Programmable Gate Array), or code for a hardware description language such as Verilog™ or VHDL (Very high speed integrated circuit Hardware Description Language). As the skilled person will appreciate such code and/or data may be distributed between a plurality of coupled components in communication with one another. The invention may comprise a controller which includes a microprocessor, working memory and program memory coupled to one or more of the components of the system.

These and other aspects will be apparent from the embodiments described in the following. The scope of the present disclosure is not intended to be limited by this summary nor to implementations that necessarily solve any or all of the disadvantages noted.

BRIEF DESCRIPTION OF THE DRAWINGS

For a better understanding of the present disclosure and to show how embodiments may be put into effect, reference is made to the accompanying drawings in which.

DETAILED DESCRIPTION

Embodiments will now be described by way of example only.

Figure 1:
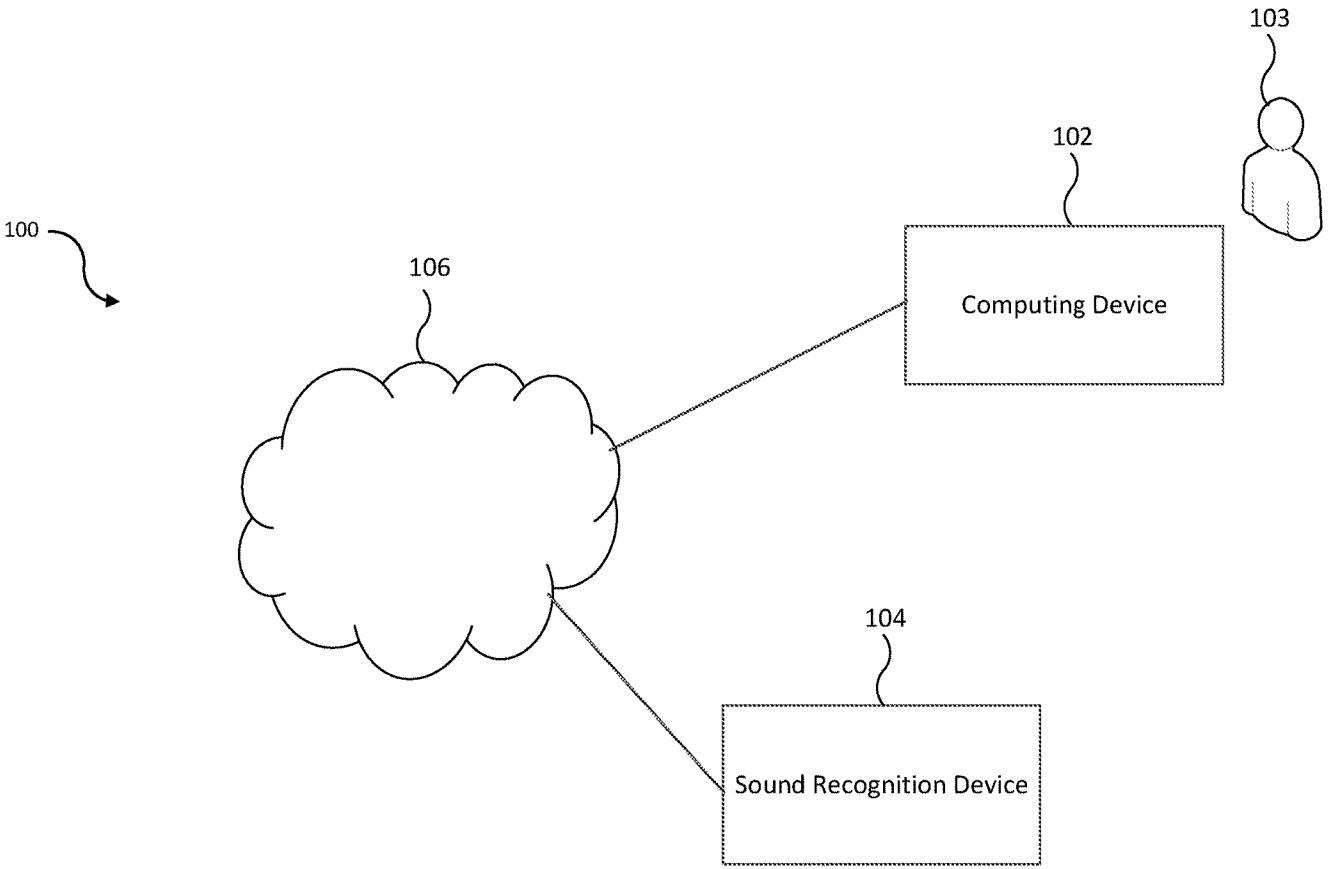
FIG. 1 shows a block diagram of example devices in a monitored environment.

FIG. 1 shows a computing device 102 in a monitored environment 100 which may be an indoor space (e.g. a house, a gym, a shop, a railway station etc.), an outdoor space or in a vehicle. The computing device 102 is associated with a user 103.

The network 106 may be a wireless network, a wired network or may comprise a combination of wired and wireless connections between the devices.

As described in more detail below, the computing device 102 may perform audio processing to recognise, i.e. detect, a target sound in the monitored environment 100. In alternative embodiments, a sound recognition device 104 that is external to the computing device 102 may perform the audio processing to recognise a target sound in the monitored environment 100 and then alert the computing device 102 that a target sound has been detected.

Figure 2:
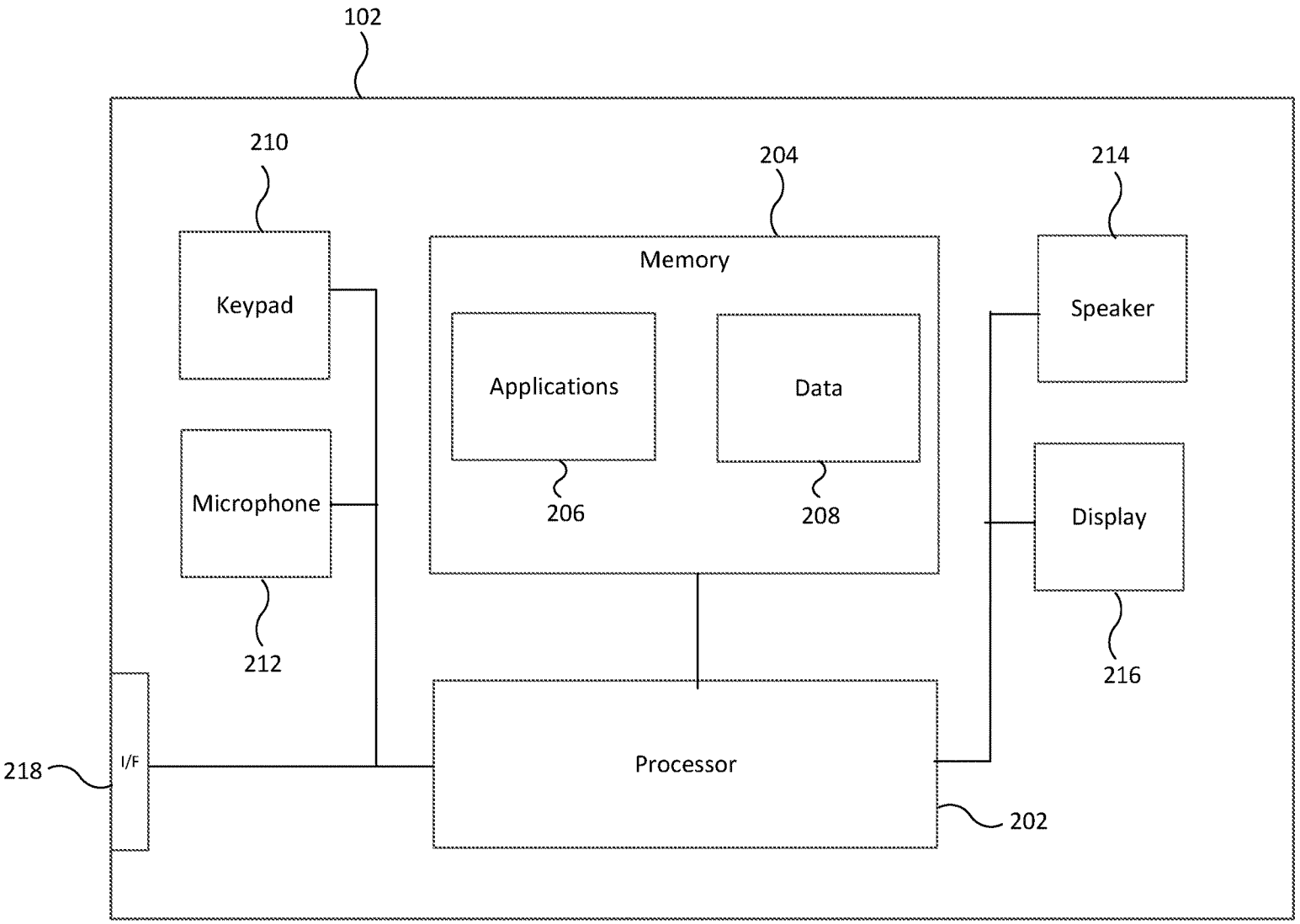
FIG. 2 shows a block diagram of a computing device.

FIG. 2 shows a block diagram of the computing device 102. It will be appreciated from the below that FIG. 2 is merely illustrative and the computing device 102 of embodiments of the present disclosure may not comprise all of the components shown in FIG. 2.

The computing device 102 may be a PC, a mobile computing device such as a laptop, smartphone, tablet-PC, a consumer electronics device (e.g. a smart speaker, TV, headphones, wearable device etc.), or other electronics device (e.g. an in-vehicle device). The computing device 102 may be a mobile device such that the user 103 can move the computing device 102 around the monitored environment. Alternatively, the computing device 102 may be fixed at a location in the monitored environment (e.g. a panel mounted to a wall of a home). Alternatively, the device may be worn by the user by attachment to or sitting on a body part or by attachment to a piece of garment.

Figure 3:
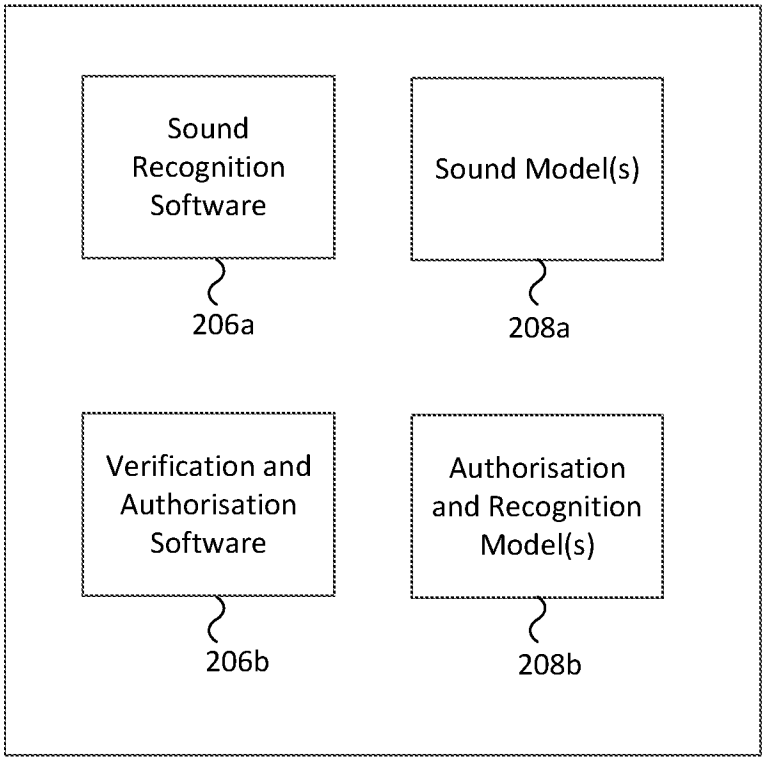
FIG. 3 shows a block diagram of software implemented on the computing device.

The computing device 102 comprises a processor 202 coupled to memory 204 storing computer program code of application software 206 operable with data elements 208. As shown in FIG. 3, a map of the memory in use is illustrated. A sound recognition process 206*a* is used to recognise a target sound, by comparing detected sounds to one or more sound models 208*a* stored in the memory 204. The sound model(s) 208*a* may be associated with one or more target sounds (which may be for example, a breaking glass sound, a smoke alarm sound, a baby cry sound, a sound indicative of an action being performed, etc.).

A identity verification and authorisation process 206*b* is operable with reference to identity and authorisation data 208*b* on the basis of a detected presence by the sound recognition process 206*a*. The identity verification and authorisation process 206*b* is operable to trigger, on the basis of a detected presence, an identity verification interface with a user, such as by audio and/or visual output and input. In some cases, as discussed, no audio/visual output is necessary to perform this process.

The computing device 102 may comprise one or more input device e.g. physical buttons (including single button, keypad or keyboard) or physical control (including rotary knob or dial, scroll wheel or touch strip) 210 and/or microphone 212. The computing device 102 may comprise one or more output device e.g. speaker 214 and/or display 216. It will be appreciated that the display 216 may be a touch sensitive display and thus act as an input device.

The computing device 102 may also comprise a communications interface 218 for communicating with the sound recognition device. The communications interface 218 may comprise a wired interface and/or a wireless interface.

As shown in FIG. 3, the computing device 102 may store the sound models locally (in memory 204) and so does not need to be in constant communication with any remote system in order to identify a captured sound. Alternatively, the storage of the sound model(s) 208 is on a remote server (not shown in FIG. 2) coupled to the computing device 102, and sound recognition software 206 on the remote server is used to perform the processing of audio received from the computing device 102 to recognise that a sound captured by the computing device 102 corresponds to a target sound. This advantageously reduces the processing performed on the computing device 102.

Sound Model and Identification of Target Sounds

A sound model 208 associated with a target sound is generated based on processing a captured sound corresponding to the target sound class. Preferably, multiple instances of the same sound are captured more than once in order to improve the reliability of the sound model generated of the captured sound class.

In order to generate a sound model the captured sound class(es) are processed and parameters are generated for the specific captured sound class. The generated sound model comprises these generated parameters and other data which can be used to characterise the captured sound class.

There are a number of ways a sound model associated with a target sound class can be generated. The sound model for a captured sound may be generated using machine learning techniques or predictive modelling techniques such as: hidden Markov model, neural networks, support vector machine (SVM), decision tree learning, etc.

The applicant's PCT application WO2010/070314, which is incorporated by reference in its entirety, describes in detail various methods to identify sounds. Broadly speaking an input sample sound is processed by decomposition into frequency bands, and optionally de-correlated, for example, using PCA/ICA, and then this data is compared to one or more Markov models to generate log likelihood ratio (LLR)

data for the input sound to be identified. A (hard) confidence threshold may then be employed to determine whether or not a sound has been identified; if a "fit" is detected to two or more stored Markov models then preferably the system picks the most probable. A sound is "fitted" to a model by effectively comparing the sound to be identified with expected frequency domain data predicted by the Markov model. False positives are reduced by correcting/updating means and variances in the model based on interference (which includes background) noise.

It will be appreciated that other techniques than those described herein may be employed to create a sound model.

The sound recognition system may work with compressed audio or uncompressed audio. For example, the time-frequency matrix for a 44.1 KHz signal might be a 1024 point FFT with a 512 overlap. This is approximately a 20 milliseconds window with 10 millisecond overlap. The resulting 512 frequency bins are then grouped into sub bands, or example quarter-octave ranging between 62.5 to 8000 Hz giving 30 sub-bands.

A lookup table can be used to map from the compressed or uncompressed frequency bands to the new sub-band representation bands. For the sample rate and STFT size example given the array might comprise of a (Bin size÷2)×6 array for each sampling-rate/bin number pair supported. The rows correspond to the bin number (centre)—STFT size or number of frequency coefficients. The first two columns determine the lower and upper quarter octave bin index numbers. The following four columns determine the proportion of the bins magnitude that should be placed in the corresponding quarter octave bin starting from the lower quarter octave defined in the first column to the upper quarter octave bin defined in the second column. e.g. if the bin overlaps two quarter octave ranges the 3 and 4 columns will have proportional values that sum to 1 and the 5 and 6 columns will have zeros. If a bin overlaps more than one sub-band more columns will have proportional magnitude values. This example models the critical bands in the human auditory system. This reduced time/frequency representation is then processed by the normalisation method outlined. This process is repeated for all frames incrementally moving the frame position by a hop size of 10 ms. The overlapping window (hop size not equal to window size) improves the time-resolution of the system. This is taken as an adequate representation of the frequencies of the signal which can be used to summarise the perceptual characteristics of the sound. The normalisation stage then takes each frame in the sub-band decomposition and divides by the square root of the average power in each sub-band. The average is calculated as the total power in all frequency bands divided by the number of frequency bands. This normalised time frequency matrix is the passed to the next section of the system where a sound recognition model and its parameters can be generated to fully characterise the sound's frequency distribution and temporal trends.

The next stage of the sound characterisation requires further definitions.

A machine learning model is used to define and obtain the trainable parameters needed to recognise sounds. Such a model is defined by:

a set of trainable parameters $\theta$, for example, but not limited to, means, variances and transitions for a hidden Markov model (HMM), support vectors for a support vector machine (SVM), weights, biases and activation functions for a deep neural network (DNN), a data set with audio observations o and associated sound labels l, for example a set of audio recordings which capture a set of target sounds of interest for recognition such as, e.g., baby cries, dog barks or smoke alarms, as well as other background sounds which are not the target sounds to be recognised and which may be adversely recognised as the target sounds. This data set of audio observations is associated with a set of labels l which indicate the locations of the target sounds of interest, for example the times and durations where the baby cry sounds are happening amongst the audio observations o.

Generating the model parameters is a matter of defining and minimising a loss function $\mathcal{L}(\theta|o,l)$ across the set of audio observations, where the minimisation is performed by means of a training method, for example, but not limited to, the Baum-Welsh algorithm for HMMs, soft margin minimisation for SVMs or stochastic gradient descent for DNNs.

To classify new sounds, an inference algorithm uses the model to determine a probability or a score $P(C|o,\theta)$ that new incoming audio observations o are affiliated with one or several sound classes C according to the model and its parameters $\theta$. Then the probabilities or scores are transformed into discrete sound class symbols by a decision method such as, for example but not limited to, thresholding or dynamic programming.

The models will operate in many different acoustic conditions and as it is practically restrictive to present examples that are representative of all the acoustic conditions the system will come in contact with, internal adjustment of the models will be performed to enable the system to operate in all these different acoustic conditions. Many different methods can be used for this update. For example, the method may comprise taking an average value for the sub-bands, e.g. the quarter octave frequency values for the last T number of seconds. These averages are added to the model values to update the internal model of the sound in that acoustic environment.

In embodiments whereby the computing device 102 performs audio processing to recognise a target sound in the monitored environment 100, this audio processing comprises the microphone 212 of the computing device 102 capturing a sound, and the sound recognition 206*a* analysing this captured sound. In particular, the sound recognition 206*a* compares the captured sound to the one or more sound models 208*a* stored in memory 204. If the captured sound matches with the stored sound models, then the sound is identified as the target sound.

On the basis of the identification of a target sound, or a recognised sequence of target sounds, indicative of the presence of a target, a signal is sent from the sound recognition process to the identity verification process indicating detection of a presence.

In this disclosure, target sounds of interest are non-verbal sounds. A number of use cases will be described in due course, but the reader will appreciate that a variety of non-verbal sounds could operate as triggers for presence detection. The present disclosure, and the particular choice of examples employed herein, should not be read as a limitation on the scope of applicability of the underlying concepts.

Process

Figure 4:
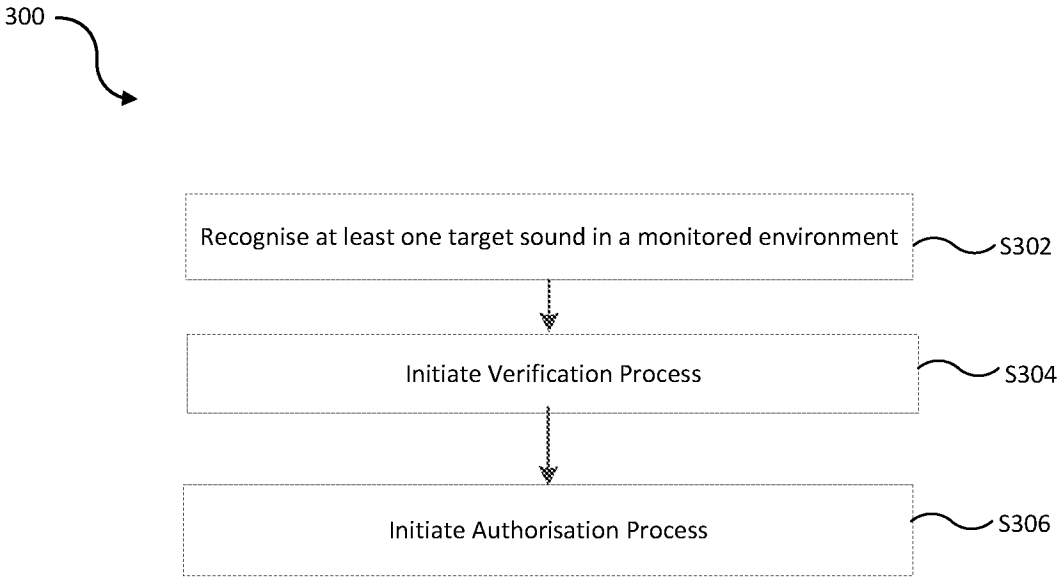
FIG. 4 is a flow chart illustrating a process to monitor presence of authorised persons of the computing device according to an embodiment.

An overview of a method implementing the specific embodiment will now be described with reference to FIG. 4. As shown in FIG. 4, in general terms, a first step S302 comprises a recognition at a target presence detection stage, of the recognition of at least a target sound, or a sequence of sounds, which are a signature of the presence of a target of interest.

Then, if recognition occurs, in a second step S304, a verification process takes place. Finally, if the identity of the target takes place, then in step S306, an authorisation process takes place. Verification and authorisation may be combined in a single process, in certain embodiments.

Figure 5:
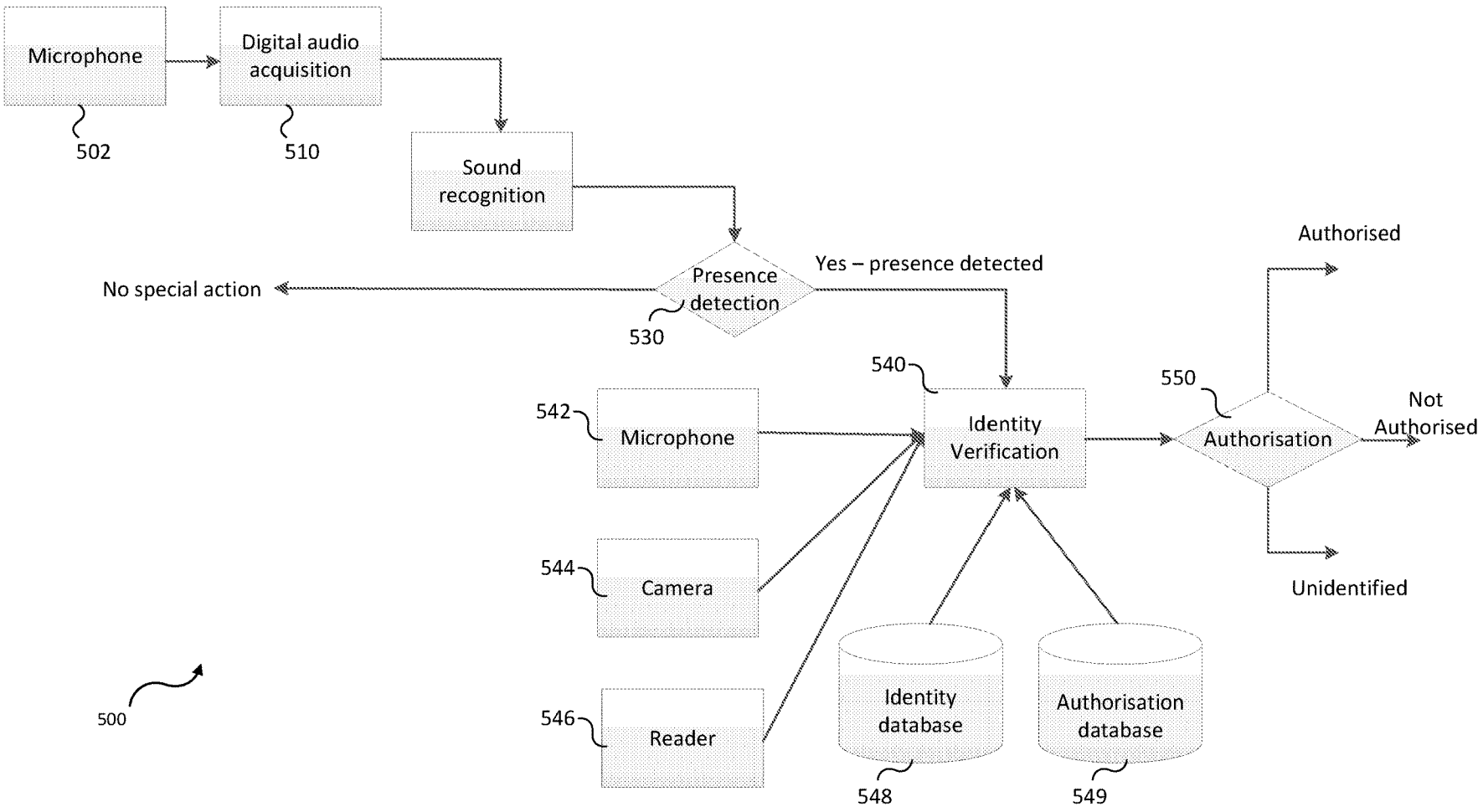
FIG. 5 is a process architecture diagram illustrating an implementation of an embodiment and indicating function and structure of such an implementation.

As shown in FIG. 5, a system 500 implements the above method in a number of stages.

Firstly, a microphone 502 is provided to monitor sound in the location of interest.

Then, a digital audio acquisition stage 510, implemented at the sound recognition computer, continuously transforms the audio captured through the microphone into a stream of digital audio samples.

A sound recognition stage 520 comprises the sound recognition computer continuously running a programme to recognise non-verbal sounds from the incoming stream of digital audio samples, thus producing a sequence of identifiers for the recognised non-verbal sounds. This can be done with reference to sound models 208*a* as previously illustrated.

A presence decision 530 is then taken: from the sequence of sound identifiers, the sound recognition computer runs a program to determine whether the recognised sounds and/or their combination are indicators of presence of a subject such as a human, an animal, a car etc.

If no presence is recognised, then no special action arises, and the process continues to monitor for target sound events.

If the recognition of presence is positive, then the identity verification computer starts running a process 540 of identity verification which may span, for example:

asking the subject whose presence is recognised to speak into a microphone 542 (which may be the same as the first microphone 502), so that voice identification can be performed to verify their identity from the sound of their voice, asking the subject to submit to another biometric identification methods such as fingerprint recognition or iris scanning, for instance using a camera 544, asking the subject to present a barcode or a QR code printed on an identification document or on a parcel to be delivered, whereby the barcode is read and verified via laser or camera by the identity verification computer, again using the camera 544 or another implementation specific reader 546, asking the subject to present an ID document on which the identity verification computer can perform optical character recognition, for example recognising and verifying a passport number automatically via the camera 544, seeking identity information that is passively emitted by the subject, for example recognising someone's face, recognising the barks of a certain dog, or detecting the plate number of an approaching vehicle, without requiring the subject to perform any special action.

To do this, the identity verification process 540 accesses a database 548 of identifying information (for example fingerprint records, voice prints or identification codes), either stored on the identity verification computer, or queried via networking to another computer.

Then, on obtaining an identity verification (or not as the case may be) the identity verification computer runs an authorisation process 550 to combine recognition of presence and identity information into a decision about the presence being authorised or not. The decision on authorised, unauthorised or unidentified presence for the detected presence is thereafter transformed into actions on behalf of the user, for example unlocking a smart door lock in case of authorised presence, or sending an alert to the user's mobile phone in case of unauthorised or unidentified presence.

This authorisation decision, in this embodiment, requires access to an identity authorisation (a.k.a. access control) database 549, either stored into the identity verification computer, or queried from a separate computer, possibly via networking. In certain embodiments, the identity database 548 and the authorisation database 549 may be combined.

For example, in the case of checking authorisation of a delivery operative, the identity and authorisation data could be held by the delivery business. On the other hand, for authorisation of presence of family members into their own house, the data would be held by the system owner. At the lower extreme, the identity and authorisation databases could contain only one identity which would be that of the single system owner whose presence is authorised or expected within the perimeter monitored by the system.

Where embodiments herein refer to authorisation, the reader will appreciate, especially from earlier references thereto, that aspects of the present disclosure can be applied to any implementation which can take advantage of establishing identity and then taking action on the basis of that established identity.

Embodiments described herein couple a machine learning approach to sound recognition, with a further machine learning approach to automatic identity verification. By this, identity verification and authorisation of presence are triggered when necessary and without relying on user input. In simple terms, embodiments are automatically able to answer "Who's here" and to inform the user appropriately and when necessary about identified presence within the monitored environment.

The invention claimed is:

1. A computer system for detecting a presence at a designated location, the system comprising a sound processor, the sound processor having access to one or more trained sound models, the one or more trained sound models being generated through machine learning, the sound processor being configured to:

process audio data for a sequence of non-verbal sounds, wherein the sequence of non-verbal sounds comprises a first non-verbal sound and a second non-verbal sound, the second non-verbal sound being non-identical to the first non-verbal sound, in said designated location;

determine a first measure of similarity between the audio data for the first non-verbal sound and the trained sound models, the first measure of similarity representing a first classification corresponding with the first non-verbal sound;

determine a second measure of similarity between the audio data for the second non-verbal sound and the trained sound models, the second measure of similarity representing a second classification corresponding with the second non-verbal sound, the second classification being different from the first classification;

determine from the first and second classifications, in combination, of the sequence of non-verbal sounds, an identity verification target corresponding to the sequence of non-verbal sounds including the first non-verbal sound classified as the first classification and the second non-verbal sound classified as the second classification; and in response to determining that the sequence of non-verbal sounds corresponds with the identity verification target, send a presence indication message to a verification unit that causes the verification unit to perform a verification of an identity of the identity verification target, wherein the computer system further comprises the verification unit and the verification unit is operable on the basis of receiving said presence indication message, to acquire identification information concerning the identity verification target, and to use the acquired identification information along with identity data to produce an identity result for the identity verification target, and to access an authorisation database containing authorisation data, and to perform an authorisation decision on the basis of the identity result, and the contained authorisation data, to produce an authorisation result.

2. The computer system in accordance with claim 1, wherein the presence indication message comprises an indication of the presence of the identity verification target.

3. The computer system of claim 1, wherein the verification unit is configured to perform a verification of an identity number associated with the identity verification target.

4. The computer system of claim 3, wherein the verification unit is configured to read the identity number from an identification medium associated with the identity verification target.

5. A method of detecting a presence at a designated location, the method comprising:

processing audio data for a sequence of non-verbal sounds, wherein the sequence of non-verbal sounds comprises a first non-verbal sound and a second non-verbal sound, the second non-verbal sound being non-identical to the first non-verbal sound, in said designated location;

determining a measure of similarity between the audio data for the first non-verbal sound and the trained sound models, determining a measure of similarity between the audio data for the second non-verbal sound and the trained sound models;

determining from the measures of similarity, in combination, of the sequence of non-verbal sounds, an identity verification target corresponding to the sequence of non-verbal sounds including the first non-verbal sound and the second non-verbal sound in response to determining that the sequence of non-verbal sounds corresponds with the identity verification target, sending a presence indication message to a verification unit that causes the verification unit to verify an identity of the identity verification target;

acquiring identification information concerning the identity verification target, and using the acquired identification information along with identity data to produce an identity result for the identity verification target;

accessing an authorisation database to obtain authorisation data; and performing an authorisation decision on the basis of the identity result, and the obtained authorisation data, to produce an authorisation result.

6. The method in accordance with claim 5, wherein the presence indication message indicates the presence of the identity verification target.

7. A non-transitory computer storage medium, storing computer executable instructions which, when executed on a computer, cause that computer to perform a method of detecting a presence at a designated location, the method comprising:

processing audio data for a sequence of non-verbal sounds, wherein the sequence of non-verbal sounds comprises a first non-verbal sound and a second non-verbal sound, the second non-verbal sound being non-identical to the first non-verbal sound, in said designated location;

determining a measure of similarity between the audio data for the first non-verbal sound and the trained sound models, determining a measure of similarity between the audio data for the second non-verbal sound and the trained sound models;

determining from the measures of similarity, in combination, of the sequence of non-verbal sounds, an identity verification target corresponding to the sequence of non-verbal sounds including the first non-verbal sound and the second non-verbal sound;

in response to determining that the sequence of non-verbal sounds corresponds with the identity verification target, sending a presence indication message to a verification unit that causes the verification unit to verify an identity of the identity verification target;

acquiring identification information concerning the identity verification target, and using the acquired identification information along with identity data to produce an identity result for the identity verification target;

accessing an authorisation database to obtain authorisation data; and performing an authorisation decision on the basis of the identity result, and the obtained authorisation data, to produce an authorisation result.

8. A computer system for detecting a presence at a designated location, the system comprising a sound processor, the sound processor having access to one or more trained sound models, the one or more trained sound models being generated through machine learning, the sound processor being configured to:

process audio data for a non-verbal sound in said designated location to determine, by a measure of similarity between the audio data for the non-verbal sound and the trained sound models, if the non-verbal sound is indicative of a presence of an identity verification target; and in response to determining that the non-verbal sound is indicative of the presence of the identity verification target, send a presence indication message to a verification unit that causes the verification unit to perform a verification of an identity of the identity verification target, wherein the computer system further comprises the verification unit and the verification unit is operable on the basis of receiving said presence indication message, to acquire identification information concerning the identity verification target, and to use the acquired identification information along with identity data to produce an identity result for the identity verification target, and to access an authorisation database containing authorisation data, and to perform an authorisation decision on the basis of the identity result, and the contained authorisation data, to produce an authorisation result.

* * * * *